US005653615A

United States Patent [19]

Inaba et al.

[11] Patent Number: 5,653,615

[45] Date of Patent: Aug. 5, 1997

[54] LARGE CURRENT TERMINAL AND METHOD OF METAL-WORKING SAME

[75] Inventors: Shigemitsu Inaba; Mitsuhiro Matsumoto; Satoki Masuda, all of Shizuoka, Japan

[73] Assignee: Yazaki Corporation, Tokyo, Japan

[21] Appl. No.: 405,854

[22] Filed: Mar. 17, 1995

[30] Foreign Application Priority Data

Mar. 18, 1994 [JP] Japan ..... 6-049130

[51] Int. Cl.[6] ..... H01R 13/17

[52] U.S. Cl. ..... 439/827; 439/843

[58] Field of Search ..... 439/827, 843

[56] References Cited

U.S. PATENT DOCUMENTS

| | | | |
|---|---|---|---|
| 3,861,776 | 1/1975 | Deal | 439/843 |
| 4,550,972 | 11/1985 | Romak | 439/843 |
| 4,585,294 | 4/1986 | Wolowicz et al. | 439/827 |
| 4,929,188 | 5/1990 | Lionetto et al. | 439/827 |
| 5,108,318 | 4/1992 | Sakurai et al. | 439/843 |
| 5,147,229 | 9/1992 | Nestor | 439/843 |

FOREIGN PATENT DOCUMENTS

| | | | |
|---|---|---|---|
| 63-124383 | 5/1988 | Japan | H01R 13/11 |

*Primary Examiner*—Neil Abrams
*Assistant Examiner*—Barry Matthew L. Standig
*Attorney, Agent, or Firm*—Sughrue, Mion, Zinn, Macpeak & Seas

[57] ABSTRACT

An object of the invention is to quickly supply inexpensive large current terminals without entailing complicated metal-working process and labor. Further, another object thereof is to provide methods of metal-working such terminals. A large current male terminal is constructed by forming a hollow cylindrical electric contact part on one end of a conductive pipe, a hollow cylindrical wire crimping part on the other end thereof, and a collar between the electric contact part and the wire crimping part. The electric contact part has a substantially conical nose and is formed by squeezing one end of the conductive pipe in such a manner that the diameter of the one end is gradually reduced frontward. The wire crimping part has such an inner diameter as to allow a wire to be inserted thereinto. The collar has a diameter larger than the other parts.

37 Claims, 6 Drawing Sheets

LARGE CURRENT TERMINAL AND METHOD OF METAL-WORKING SAME

BACKGROUND OF THE INVENTION

1. Field of The Invention

The invention relates to large current terminals and methods of metal-working .such terminals. More particularly, the invention is directed to large current terminals applied to connectors used for wire harnesses of electric cars, their structure, and methods of making such terminals.

2. Related Art

Since connectors used as wire harnesses for electric cars must have a large current-carrying capacity, terminals thereof, both male terminals and female terminals, must also have a structure suitable for high ampacity.

To achieve high ampacity and low contact resistance, terminals of a connector have been formed by cutting a solid conductive rod having a round cross-section.

The structure of such a male terminal for the connector (hereinafter referred to simply as "the male terminal") and a female terminal for the connector (hereinafter referred to simply as "the female terminal") as well as methods of forming such terminals will hereunder be described with reference to the accompanying drawings, which are FIGS. 16 to 19.

FIG. 16 is a side view of a female terminal made by a cutting process; and FIG. 17 is a sectional view taken along a line X—X of FIG. 16. In FIGS. 16 and 17, a female terminal 51 is formed by cutting the outer circumference and inside of a solid round rod 52 with a cutting tool. A wire crimping part 53 and an electric contact part 54 are also formed by the same cutting process. In addition, an engaging hole 55 for allowing a cylindrical contact spring member to be inserted and engaged with the inner circumferential wall of the female terminal is also bored similarly with the cutting tool.

Then, FIG. 18 is a side view of a male terminal made by a cutting process; and FIG. 19 is a sectional view taken along a line Y—Y of FIG. 18. In FIGS. 18 and 19, a male terminal 61 is similarly formed by cutting the outer circumference and inside of a solid round rod 62 with a cutting tool. A wire crimping part 63, an electric contact part 64, and a collar 65 are respectively formed by the same cutting process. In addition, a hollow space 67 for engaging a caplike contact with the inner wall of the nose of the electric contact part 64 is also bored similarly with a cutting tool.

However, to implement accurate metal working of the terminals based on the aforementioned art, it takes time since the main part of such work is the cutting process. Moreover, although it is possible to automate the major part of the cutting process, the finishing work must depend on the skill of an operator, from which arises inconsistency in product quality. As a result, the problem of inconsistent finishes of the products have been imposed.

Furthermore, the problem of high cost has also been encountered.

SUMMARY OF THE INVENTION

The invention has been made in consideration of the aforementioned circumstances. Accordingly, the object of the invention is to quickly supply inexpensive large current terminals without entailing complicated metal-working process and labor, and to further provide methods of metal-working such terminals.

To achieve the above object, the invention is applied to a large current male terminal that has a hollow cylindrical electric contact part on one end thereof, a hollow cylindrical wire crimping part on the other end thereof, and a collar between the electric contact part and the wire crimping part. The electric contact part, the wire crimping part, and the collar are integrally formed of a conductive pipe. The electric contact part has a substantially conical nose formed by gradually reducing the diameter of the conductive pipe at the one end frontward. The wire crimping part has such an inner diameter as to allow a wire to be inserted thereinto. The collar has a diameter larger than the other parts.

Or, a retaining groove may be provided along the outer circumference of the electric contact part so that a contact spring member is retained by the retaining groove from outside. The contact spring member has a projecting strip and a recessed strip, the projecting strip resiliently bulging outward from a middle part of a cylindrical main body of the contact spring member and the recessed strip resiliently bulging inward.

The invention is also applied to a large current female terminal that has a hollow cylindrical electric contact part on one end thereof, a hollow cylindrical wire crimping part on other end thereof, and a collar between the electric contact part and the wire crimping part. The electric contact part, the wire crimping part, and the collar are integrally formed of a conductive pipe. The electric contact part has such an inner diameter as to allow the male terminal to be inserted thereinto. The wire crimping part has such an inner diameter as to allow a wire to be inserted thereinto. The collar has a diameter larger than the other parts.

Or, an engaging groove may be provided along the inner circumference of the electric contact part so that a contact spring member can be engaged with the engaging groove from inside. The contact spring member has a projecting strip and a recessed strip, the projecting strip resiliently bulging outward from a middle part of a cylindrical main body of the contact spring member and the recessed strip resiliently bulging inward.

A method of metal-working a large current male terminal of the invention comprises the steps of: projecting a conductive pipe of a predetermined length to form the collar; and squeezing an electric contact part by gradually reducing the diameter of one end of the pipe frontward so that the nose thereof becomes substantially conical.

Or, the method of metal-working the large current male terminal may further comprise the step of cutting a retaining groove along the outer circumference of the pipe in addition to the projecting step and the squeezing step.

A method of metal-working a large current female terminal of the invention may comprise the step of projecting a conductive pipe of a predetermined length to form the collar.

Or, the method of metal-working a large current female terminal may further comprise the step of projecting an engaging groove for engaging the contact spring member along the inner circumference of the pipe in addition to the projecting step for forming the collar.

The large current male terminal of the invention has a hollow cylindrical electric contact part on one end thereof, a hollow cylindrical wire crimping part on the other end thereof, and a collar between the electric contact part and the wire crimping part. The electric contact part, the wire crimping part, and the collar are integrally formed of a conductive pipe. The electric contact part has a substantially conical nose formed by gradually reducing the diameter of the conductive pipe at the one end frontward. The wire crimping part has such an inner diameter as to allow a wire to be inserted thereinto. The collar has a diameter larger than the other parts. Therefore, the large current male terminal of the invention can be supplied inexpensively.

Or, a retaining groove may be provided along the outer circumference of the electric contact part so that a contact spring member is retained by the retaining groove from outside. The contact spring member has a projecting strip and a recessed strip, the projecting strip resiliently bulging outward from a middle part of a cylindrical main body of the contact spring member and the recessed strip resiliently bulging inward. Therefore, a large current male terminal with low contact resistance can be provided.

The large current female terminal of the invention has a hollow cylindrical electric contact part on one end thereof, a hollow cylindrical wire crimping part on other end thereof, and a collar between the electric contact part and the wire crimping part. The electric contact part, the wire crimping part, and the collar are integrally formed of a conductive pipe. The electric contact part has such an inner diameter as to allow the male terminal to be inserted thereinto. The wire crimping part has such an inner diameter as to allow a wire to be inserted thereinto. The collar has a diameter larger than the other parts. Therefore, the large current female terminal of the invention can be supplied inexpensively.

Or, an engaging groove may be provided along the inner circumference of the electric contact part so that a contact spring member can be engaged with the engaging groove from inside. The contact spring member has a projecting strip and a recessed strip, the projecting strip resiliently bulging outward from a middle part of a cylindrical main body of the contact spring member and the recessed strip resiliently bulging inward. Therefore, a large current female terminal with low contact resistance can be provided.

The method of metal-working a large current male terminal of the invention comprises the steps of: projecting a conductive pipe of a predetermined length to form the collar; and squeezing the electric contact part by gradually reducing the diameter of one end of the pipe frontward so that the nose thereof becomes substantially conical. Therefore, the large current male terminal can be made of a single pipe inexpensively as well as quickly.

Or, the method of metal-working a large current male terminal may further comprise the step of cutting the retaining groove along the outer circumference of the pipe in addition to the projecting step and the squeezing step. Therefore, a large current male terminal with low contact resistance can be made of a single pipe inexpensively as well as quickly.

Further, a method of metal-working a large current female terminal of the invention may comprise the step of projecting a conductive pipe of a predetermined length to form the collar. Therefore, the large current female terminal can be made of a single pipe inexpensively as well as quickly.

Or, a method of metal-working a large current female terminal may further comprise the step of cutting the engaging groove for engaging the contact spring member along the inner circumference of the pipe in addition to the projecting step for forming the collar. Therefore, a large current female terminal with low contact resistance can be made of a single pipe inexpensively as well as quickly.

DETAILED DESCRIPTION OF THE PREFERRED EMBODIMENTS

The construction of large current male and female terminals and methods of metal-working such terminals of the invention will be described with reference to the accompanying drawings.

Figure 1:
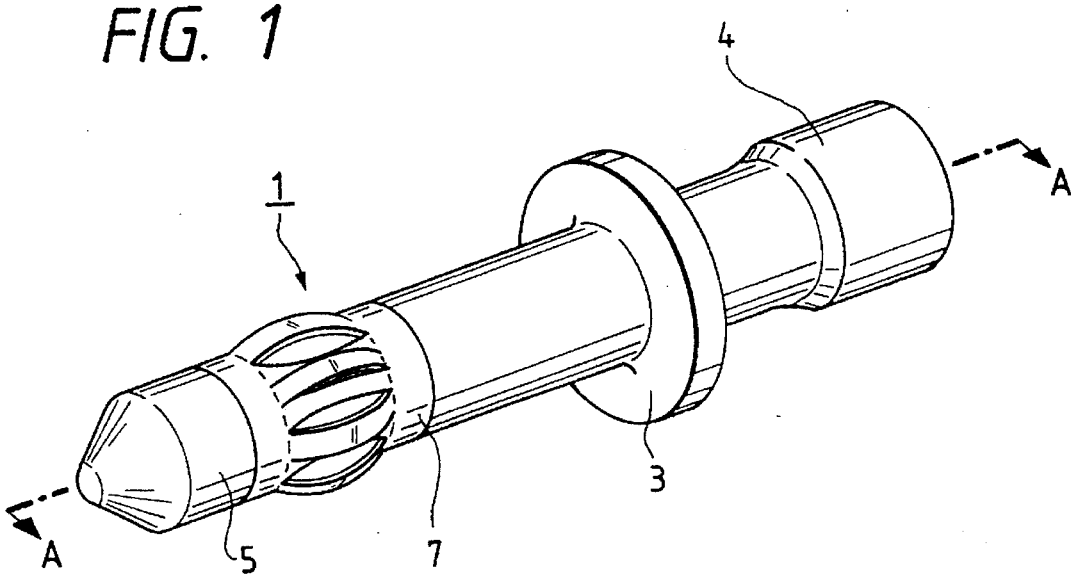
FIG. 1 is a perspective view of a male terminal, which is an embodiment of the invention.
Figure 2:
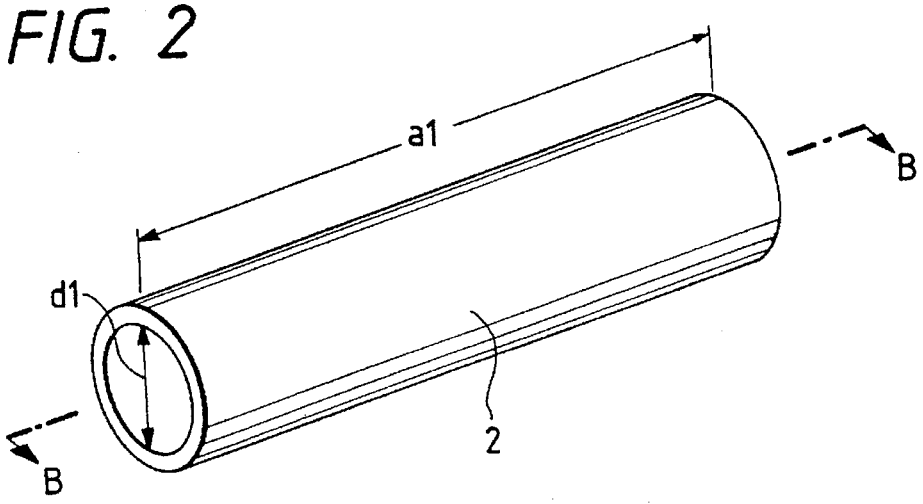
FIG. 2 is a perspective view of a conductive pipe before metal-worked.

In FIG. 1, a large current male terminal 1 of the invention is formed integrally of a conductive pipe shown in FIG. 2. In FIG. 1, one end of the male terminal 1 is formed into a hollow cylindrical electric contact part 5 forming the substantially conical nose with the diameter thereof being reduced toward the front, and the other end thereof is formed into a hollow cylindrical wire crimping part 4 having such an inner diameter as to allow a wire to be inserted thereinto. Further, between the electric contact part 5 and the wire crimping part 4 is a collar 3 whose diameter is larger than the other parts of the male terminal 1. The electric contact part 5 is inserted into an electric contact part of a female terminal 11 (see FIG. 10) so that electrical contact is established between both terminals. The female terminal 11 will be described later.

Since the male terminal 1 is formed from the single conductive pipe 2 as described above, the male terminal of the invention can be supplied at a lower cost than the conventional terminals made by cutting.

Figure 7:
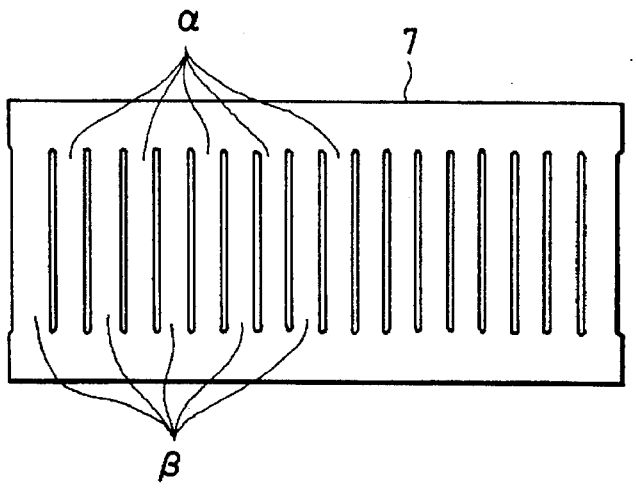
FIG. 7 is a diagram showing the development of a contact spring member.
Figure 8:
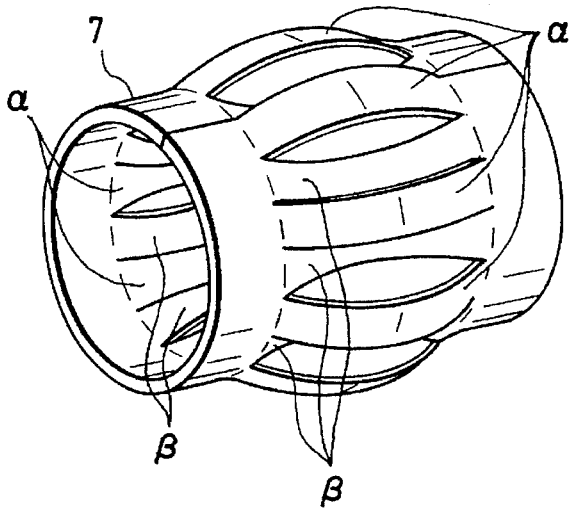
FIG. 8 is a perspective view of the fabricated contact spring of FIG. 7.

By the way, a contact spring member is attached to a part at which the male and female terminals come in electric contact with each other. This is not only to improve contact between both terminals but also to implement low contact resistance. The contact spring member has such a rectangular development as shown in FIG. 7. This contact spring member 7 is made of a resilient, high conductive material such as brass or a copper-beryllium alloy, and is prepared in the following manner. A plurality of strips formed between longitudinally pitched slits are alternately folding back and forth as viewed from the surface of the drawing sheet, and the rectangular plate is thereafter formed into a cylindrical member such as shown in FIG. 8. In FIG. 8, a strip resiliently bulging outward from the middle part of the cylindrical contact spring member 7 main body is termed as a projecting strip α and a strip resiliently bulging inward is termed as a recessed strip β.

Figure 9:
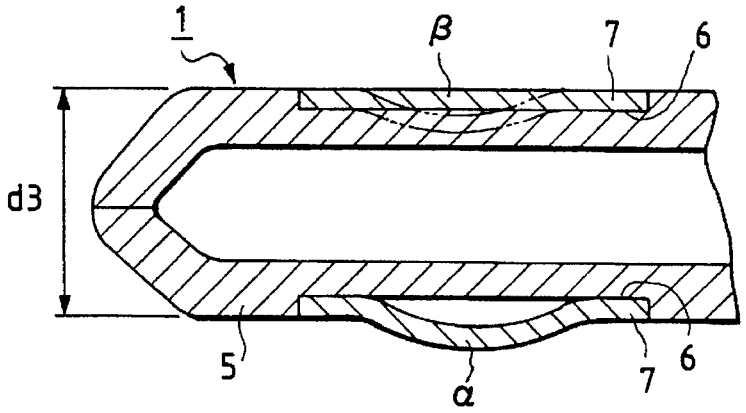
FIG. 9 is a sectional view showing a main portion of the male terminal with the contact spring member retained by the retaining groove thereof.

FIG. 1 is a perspective view of the male terminal 1 with this contact spring member 7 attached around the electric contact part 5; and FIG. 9 shows a main portion taken along a line A—A of FIG. 1. In FIG. 9, the male terminal 1 has a retaining groove 6 along the outer circumference of the electric contact part 5, and the contact spring member 7 consisting of the projecting strips α resiliently bulging outward from the middle part of the cylindrical main body thereof and the recessed strips D resiliently bulging inward is retained by the retaining groove 6 from outside.

In this case, each recessed strip β resiliently bulging inward is bounced back outward by the electric contact part 5. By making the longitudinal length of the contact spring member 7 with the projecting strips α and the recessed strips β equal to the longitudinal length of the retaining groove 6, each bounced-back recessed strip β expanding the longitudinal length of the contact spring member 7 can be blocked. As a result, the recessed strip β comes to assume, e.g., a mildly corrugated form along the retaining groove 6, thereby achieving low contact resistance by the contact thereof with the retaining groove 6 in a wide range.

On the other hand, each projecting strip α keeps bulging outward from the subrace of the electric contact part 5. The projecting strip α is bounced back inward by the surface of the electric contact part of the female terminal when the male terminal is connected to the female terminal. As a result, the projecting strip α comes to assume a mildly corrugated form between the surfaces of both electric contact parts, thereby achieving low contact resistance by the contact thereof with the surfaces of both electric contact parts in a wide range.

A method of metal-working the male terminal will be described next.

Figure 3:
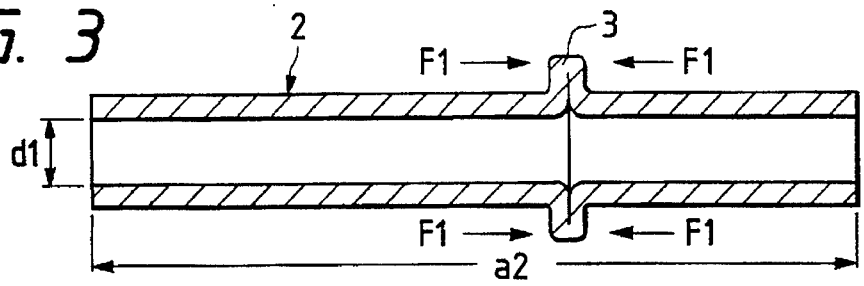
FIG. 3 is a sectional view taken along a line B—B with a collar formed on the conductive pipe of FIG. 2.
Figure 4:
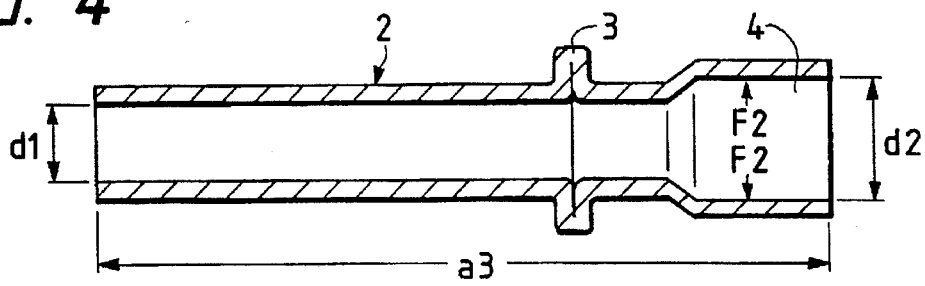
FIG. 4 is a sectional view of the conductive pipe of FIG. 3 with a wire crimping part formed.

FIG. 2 is a perspective view of a conductive pipe before metal-worked. The conductive pipe 2, which is to be metal-worked, has a predetermined length a1 and a predetermined inner diameter d1. The collar 3 is formed by the projecting process in which compressive force F1 is applied to the conductive pipe 2 toward the center as shown in a sectional view taken along a line B—B in FIG. 3. As a result of this process, the length of the conductive pipe 2 is shortened to a2 from a1. Then, as shown in FIG. 4, the inner diameter is increased to d2 by applying outwardly acting force F2 to the inner diameter on the right end of the conductive pipe 2 to form the wire crimping part 4. As a result of this process, the length of the conductive pipe 2 is further shortened to a3 from a2.

Figure 5:
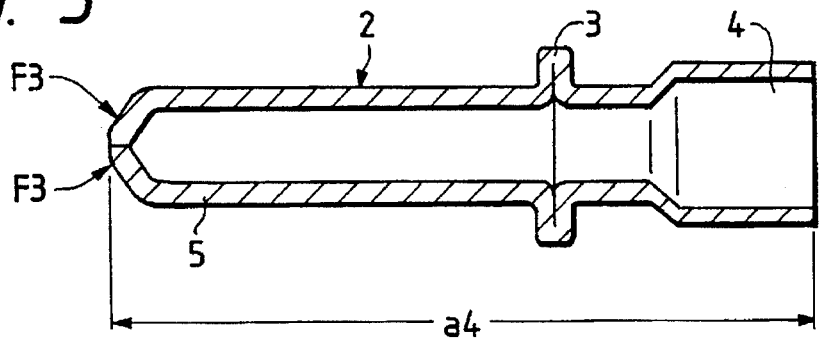
FIG. 5 is a sectional view of the conductive pipe of FIG. 4 with the nose thereof being subjected to a squeezing process.

Then, as shown in FIG. 5, force F3 is applied to the left end of the conductive pipe 2 by a squeezing process so that the diameter on the left end is gradually reduced toward the front to form the electric contact part 5 having a substantially conical nose.

Figure 6:
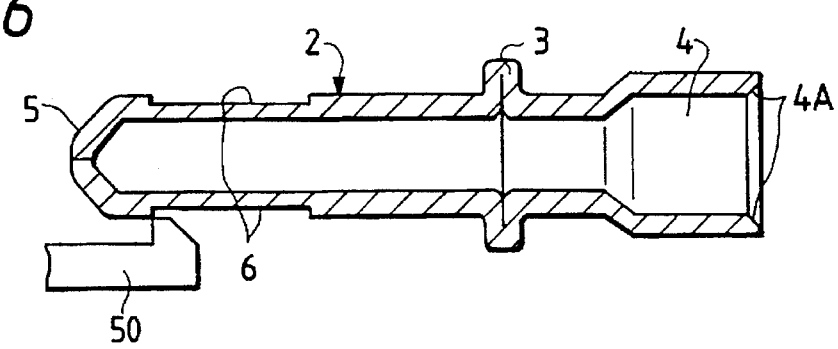
FIG. 6 is a sectional view of the conductive pipe of FIG. 5 with a retaining groove formed in an electric contact part thereof.

FIG. 6 is a sectional view of the male terminal with the retaining groove 6 formed by the process of cutting the outer circumference of the electric contact part 5 and with a chamfered part 4A formed by the process of cutting an inner diameter portion of the wire crimping part 4. It is around this retaining groove 6 that the contact spring member 7 is attached.

Figure 10:
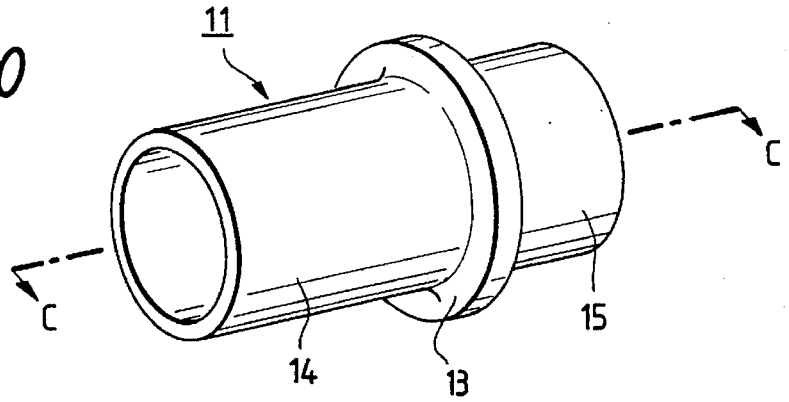
FIG. 10 is a perspective view of a female terminal, which is an embodiment of the invention.
Figure 11:
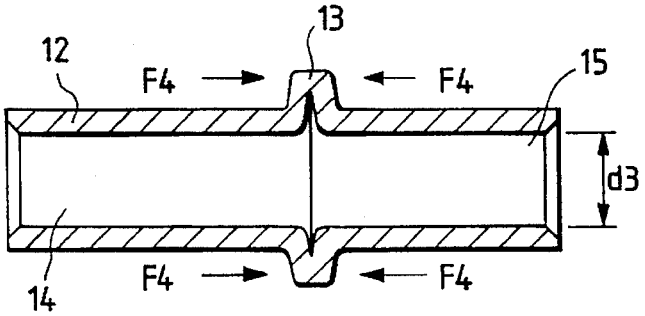
FIG. 11 is a sectional view taken along a line C—C of the female terminal of FIG. 10.

FIG. 10 is a perspective view of a female terminal 11, which is an embodiment of the invention; and FIG. 11 is a sectional view taken along a line C—C of the female terminal 11 shown in FIG. 10.

In FIGS. 10 and 11, the female terminal 11 includes: a hollow cylindrical electric contact part 15 having such an inner diameter as to allow the male terminal 1 to be inserted thereinto on one end; a hollow cylindrical wire crimping part 14 having such an inner diameter as to allow a wire to be inserted thereinto on the other end; and a collar 13 between the electric contact part 15 and the wire crimping part 14, the diameter of the collar 13 being larger than the other parts. This female terminal is integrally formed of a conductive pipe 12.

A method of metal-working the female terminal will be described below.

The collar 13 is formed by a projecting process in which compressive force F4 is applied to the conductive pipe 12 of a predetermined length which is to be metal-worked, the force being directed toward the center as shown in FIG. 11.

It may be noted that the collars 3, 13 formed on the respective terminals serve as positioning the terminals by colliding with terminal insertion parts when the terminals are inserted into the corresponding housings.

Figure 12:
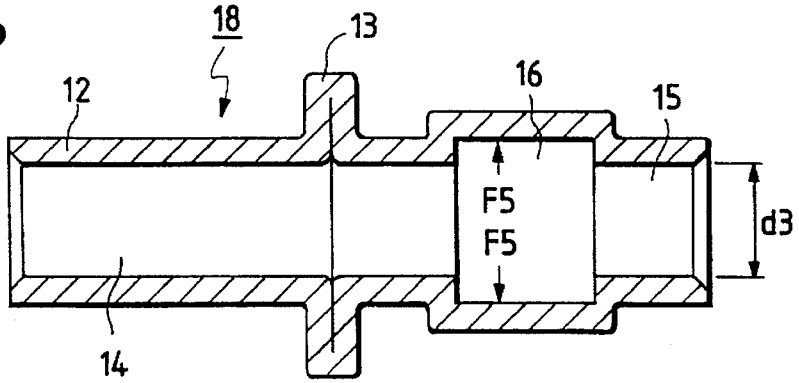
FIG. 12 is a sectional view of a female terminal, which is another embodiment of the invention.
Figure 13:
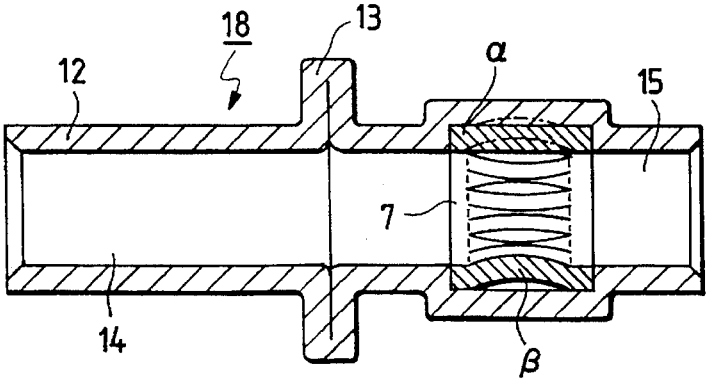
FIG. 13 is a sectional view with an engaging groove of FIG. 12 engaging a contact spring member.

FIG. 12 is a sectional view of a female terminal, which is another embodiment of the invention; and FIG. 13 is a sectional view of the female terminal with the contact spring member 7 engaged with an engaging groove 16 of FIG. 12 from inside.

A female terminal 18 shown in FIG. 12 has an engaging groove 16 along the outer circumference of the electric contact part 15. The engaging groove 16 is formed by a projecting process in which outwardly acting force F5 is applied to the electric contact part 15 from inside.

As shown in FIG. 13, when the contact spring member 7 having the projecting strips α resiliently bulging outward from the middle part of the cylindrical main body thereof and the recessed strips β resiliently bulging inward is engaged with the engaging groove 16 from inside, each projecting strip α resiliently bulging outward comes to be bounced back by the engaging groove 16. Here, by making the longitudinal length of the contact spring member 7 with the projecting strips α and the recessed strips β equal to the longitudinal length of the engaging groove 16, each bounced-back projecting strip α expanding the longitudinal length of the contact spring member 7 can be blocked. As a result, the projecting strip α comes to assume, e.g., a mildly corrugated form along the engaging groove 16, thereby achieving low contact resistance by the contact thereof with the engaging groove 16 in a wide range.

On the other hand, each recessed strip β keeps bulging inward from the surface of the electric contact part 15. The thus bulging recessed strip β is bounced back outward from the surface of the electric contact part of the male terminal when the female terminal is connected to the male terminal. As a result, the recessed strip β comes to assume a mildly corrugated form between the surfaces of both electric contact part, thereby achieving low contact resistance by the contact thereof with the surfaces of both electric contact parts in a wide range.

It may be noted that the contact spring member 7 is disposed on either one of the male and female terminals.

Figure 14:
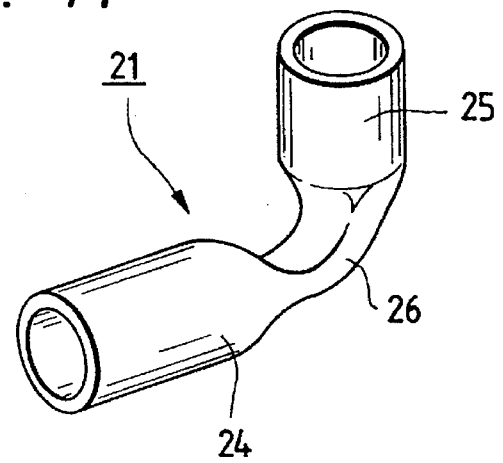
FIG. 14 is a perspective view of a female terminal, which is still another embodiment of the invention.
Figure 15:
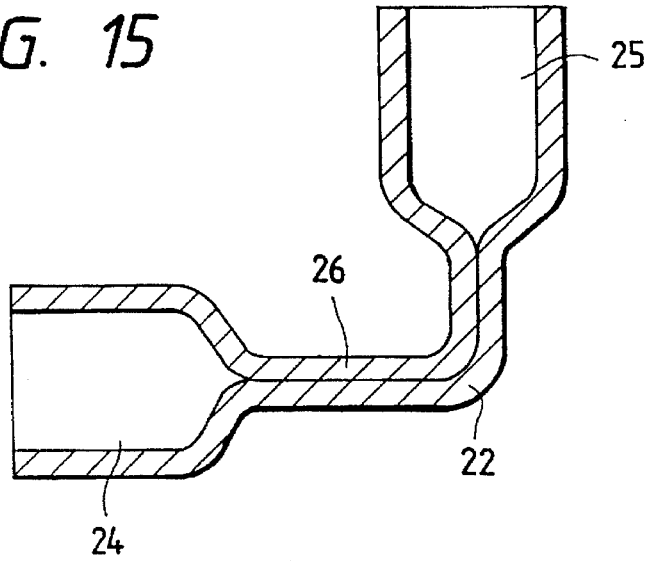
FIG. 15 is a sectional view of the female terminal of FIG. 14.
Figure 16:
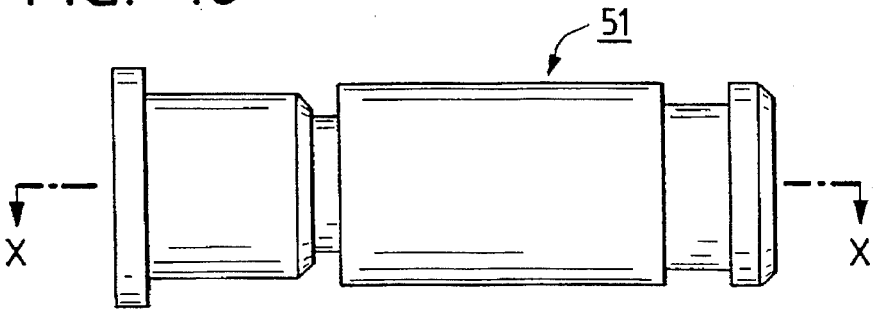
FIG. 16 PRIOR ART
FIG. 16 is a side view of a conventional female terminal.
Figure 17:
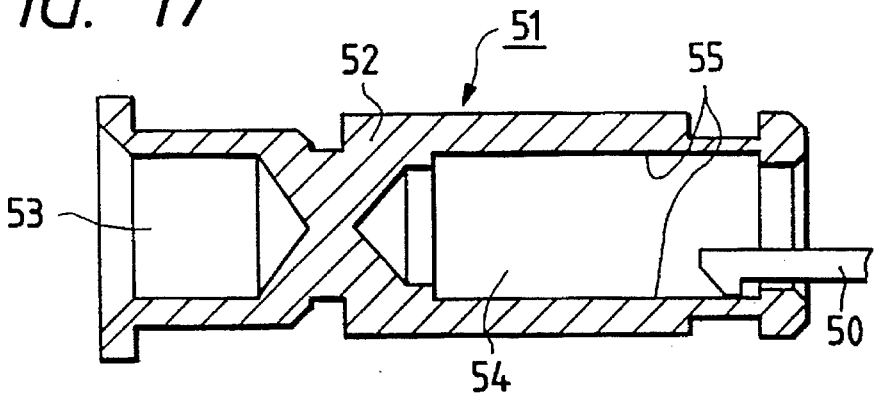
FIG. 17 PRIOR ART
FIG. 17 is a sectional view taken along a line X—X of the female terminal of FIG. 16.
Figure 18:
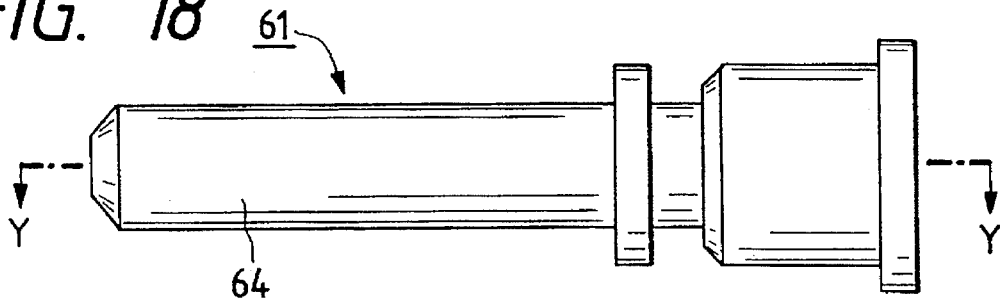
FIG. 18 is a side view of the male terminal made by a cutting process.
Figure 19:
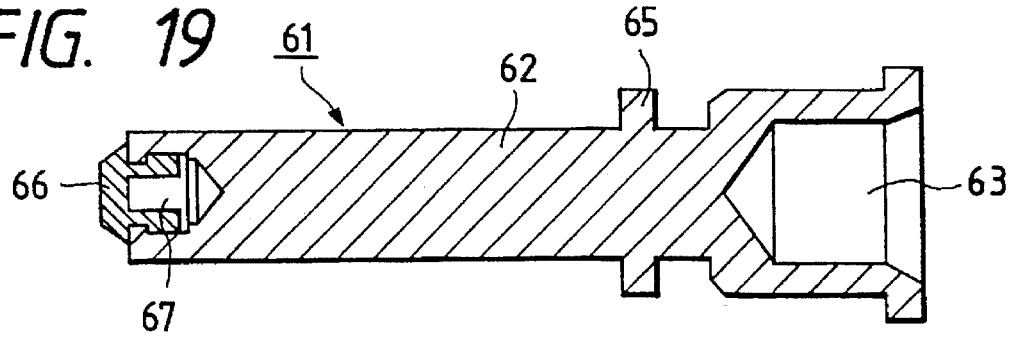
FIG. 19 is a sectional view taken along a line Y—Y of the male terminal of FIG. 18.

FIGS. 14 and 15 are a perspective view and a sectional view showing a female terminal, which is still another embodiment of the invention. In FIGS. 14 and 15, an L-shaped female terminal 21 has a flat compressed part 26 formed by compressing the middle part of a conductive pipe 22 of a predetermined length and by bending the compressed part 26 at right angles to make the conductive pipe 22 L-shaped with both ends of the compressed part 26 being formed into a wire crimping part 24 and an electric contact part 25, respectively. This L-shaped female terminal design is advantageous in terms of quick and inexpensive manufacture and supply compared with the conventional counterpart that is made by boring an L-shaped solid rod.

As is apparent from the aforementioned embodiments, the large current terminal of the invention has a hollow cylindrical electric contact part on one end thereof, a hollow cylindrical wire crimping part on the other end thereof, and a collar between the electric contact part and the wire crimping part. The electric contact part, the wire crimping part, and the collar are integrally formed of a conductive pipe. The electric contact part has a substantially conical nose formed by gradually reducing the diameter of the conductive pipe at the one end frontward. The wire crimping part has such an inner diameter as to allow a wire to be inserted thereinto. The collar has a diameter larger than the other parts. Therefore, the large current male terminal of the invention can be supplied inexpensively.

Or, a retaining groove may be provided along the outer circumference of the electric contact part so that a contact spring member is retained by the retaining groove from outside. The contact spring member has a projecting strip and a recessed strip, the projecting strip resiliently bulging outward from a middle part of a cylindrical main body of the contact spring member and the recessed strip resiliently bulging inward. Therefore, a large current male terminal with low contact resistance can be provided inexpensively.

Further, the large current female terminal of the invention has a hollow cylindrical electric contact part on one end thereof, a hollow cylindrical wire crimping part on other end thereof, and a collar between the electric contact part and the wire crimping part. The electric contact part, the wire crimping part, and the collar are integrally formed of a conductive pipe. The electric contact part has such an inner diameter as to allow the male terminal to be inserted thereinto. The wire crimping part has such an inner diameter as to allow a wire to be inserted thereinto. The collar has a diameter larger than the other parts. Therefore, the large current female terminal of the invention can be supplied inexpensively.

Or, an engaging groove may be provided along the inner circumference of the electric contact part so that a contact spring member can be engaged with the engaging groove from inside. The contact spring member has a projecting strip and a recessed strip, the projecting strip resiliently bulging outward from a middle part of a cylindrical main body of the contact spring member and the recessed strip resiliently bulging inward. Therefore, a large current female terminal with low contact resistance can be provided inexpensively.

Still further, as described in the foregoing, the method of metal-working a large current male terminal of the invention comprises the steps of: projecting a conductive pipe of a predetermined length to form the collar; and squeezing the electric contact part by gradually reducing the diameter of one end of the pipe frontward so that the nose thereof becomes substantially conical. Therefore, the large current male terminal can be made of a single pipe inexpensively as well as quickly.

Or, the method of metal-working a large current male terminal may further comprise the step of cutting the retaining groove along the outer circumference of the pipe in addition to the projecting step and the squeezing step. Therefore, a large current male terminal with low contact resistance can be made of a single pipe inexpensively as well as quickly.

Still further, a method of metal-working a large current female terminal of the invention may comprise the step of projecting a conductive pipe of a predetermined length to form the collar. Therefore, the large current female terminal can be made of a single pipe inexpensively as well as quickly.

Or, a method of metal-working the large current female terminal may further comprise the step of cutting the engaging groove for engaging the contact spring member along the inner circumference of the pipe in addition to the projecting step for forming the collar. Therefore, a large current female terminal with low contact resistance can be made of a single pipe inexpensively as well as quickly.

Still further, as a result of the aforementioned metal-working methods, not only inconsistencies in product quality can be reduced, but the number of process steps can be curtailed as well. Furthermore, occurrence of defects and reduction in yield due to dependency on the skill of an operator can be avoided.

What is claimed is:

1. A large current male terminal comprising:

an electric contact part having a hollow cylindrical shape, the electric contact having a substantially conical nose;

a wire crimping part having a hollow cylindrical shape, the wire crimping part having an inner diameter to allow a wire to be inserted thereinto; and a collar having a diameter larger than at least each of the electric contact part and the wire crimping part, wherein the electric contact part, the wire crimping part, and the collar are integrally formed of a conductive pipe which is continuous around the circumference thereof.

2. A large current male terminal as claimed in claim 1, further comprising:

a retaining groove provided along an outer circumference of the electric contact part; and a contact spring member mounted in the retaining groove.

3. A large current male terminal as claimed in claim 2, wherein the contact spring member has a projecting strip and a recessed strip, the projecting strip resiliently bulging outward from a cylindrical main body of the contact spring member and the recessed strip resiliently bulging inward.

4. A large current male terminal as claimed in claim 3, wherein a longitudinal length of the contact spring member, with the projecting strip and the recessed strip is substantially equal to a longitudinal length of the retaining groove.

5. A large current male terminal as claimed in claim 1, wherein the electric contact part is provided at one end of the large current male terminal, the wire crimping part is provided at the other end of the large current male terminal, and the collar is provided between the electric contact part and the wire crimping part.

6. A large current female terminal comprising:

an electric contact part having a hollow cylindrical shape, the electric contact part having an inner diameter to allow a male terminal to be adapted to be inserted thereinto;

a wire crimping part having a hollow cylindrical shape, the wire crimping part having an inner diameter to allow a wire to be inserted thereinto; and a collar having a diameter larger than at least each of the electric contact part and the wire crimping part, wherein the electric contact part, the wire crimping part, and the collar are integrally formed of a conductive pipe which is continuous around the circumference thereof.

7. A large current female terminal as claimed in claim 6, further comprising:

an engaging groove provided along an inner circumference of the electric contact part; and a contact spring member mounted in the engaging groove.

8. A large current female terminal as claimed in claim 7, wherein the contact spring member has a projecting strip and a recessed strip, the projecting strip resiliently bulging outward from a cylindrical main body of the contact spring member and the recessed strip resiliently bulging inward.

9. A large current female terminal as claimed in claim 8, wherein a longitudinal length of the contact spring member, with the projecting strip and the recessed strip is substantially equal to a longitudinal length of the engaging groove.

10. A large current female terminal as claimed in claim 6, wherein the electric contact part is provided at one end of the large current female terminal, the wire crimping part is provided at the other end of the large current female terminal, and the collar is provided between the electric contact part and the wire crimping part.

11. A large current female terminal comprising:

an electric contact part having a hollow cylindrical shape, the electric contact part having an inner diameter to allow a male terminal to be adapted to be inserted thereinto;

a wire crimping part having hollow cylindrical shape, the wire crimping part having an inner diameter to allow a wire to be inserted thereinto; and a compressed part formed by compressing a mid-portion of a conductive pipe and by bending the compressed part mid-portion, wherein the electric contact part, the wire crimping part, and the compressed part are integrally formed of the conductive pipe which is continuous around the circumference thereof.

12. A large current female terminal as claimed in claim 11, further comprising:

an engaging groove provided along an inner circumference of the electric contact part; and a contact spring member mounted in the engaging groove.

13. A large current female terminal as claimed in claim 12, wherein the contact spring member has a projecting strip and a recessed strip, the projecting strip resiliently bulging outward from a cylindrical main body of the contact spring member and the recessed strip resiliently bulging inward.

14. A large current female terminal as claimed in claim 13, wherein a longitudinal length of the contact spring member, with the projecting strip and the recessed strip, is substantially equal to a longitudinal length of the engaging groove.

15. A large current female terminal as claimed in claim 11, wherein the electric contact part is provided at one end of the large current female terminal, and the wire crimping part is provided at the other end of the large current female terminal.

16. A large current female terminal as claimed in claim 11, wherein the compressed part is bent at substantially right angles.

17. A large current female terminal comprising:

an electric contact part having hollow cylindrical shape, the electric contact part having an inner diameter to allow a male terminal to be inserted thereinto;

a wire crimping part having a hollow cylindrical shape, the wire crimping part having an inner diameter to allow a wire to be inserted thereinto; and a collar having a diameter larger than at least each of the electric contact part and the wire crimping part, wherein the electric contact part, the wire crimping part, and the collar are integrally formed of a conductive pipe which is continuous around the circumference thereof.

18. A large current female terminal as claimed in claim 17, further comprising:

an engaging groove provided along an inner circumference of the electric contact part; and a contact spring member mounted in the engaging groove.

19. A large current female terminal as claimed in claim 18, wherein the contact spring member has a projecting strip and a recessed strip, the projecting strip resiliently bulging outward from a cylindrical main body of the contact spring member and the recessed strip resiliently bulging inward.

20. A large current female terminal as claimed in claim 19, wherein a longitudinal length of the contact spring member, with the projecting strip and the recessed strip, is substantially equal to a longitudinal length of the engaging groove.

21. A large current female terminal as claimed in claim 17, wherein the electric contact part is provided at one end of the large current female terminal, the wire crimping part is provided at the other end of the large current female terminal, and the collar is provided between the electric contact part and the wire crimping part.

22. A large current female terminal as claimed in claim 17, the male terminal includes:

an electric contact having a hollow cylindrical shape, the electric contact having a substantially conical nose;

a wire crimping part having hollow cylindrical shape, the wire crimping part having an inner diameter to allow a wire to be inserted thereinto; and a collar having a diameter larger than at least each of the electric contact part and the wire crimping part, wherein the electric contact part, the wire crimping part, and the collar are integrally formed of a conductive pipe which is continuous around the circumference thereof.

23. A large current female terminal as claimed in claim 22, the male terminal further includes:

a retaining groove provided along an outer circumference of the electric contact part; and a contact spring member mounted in the retaining groove.

24. A large current female terminal as claimed in claim 23, wherein the contact spring member has a projecting strip and a recessed strip, the projecting strip resiliently bulging outward from a cylindrical main body of the contact spring member and the recessed strip resiliently bulging inward.

25. A large current female terminal as claimed in claim 24, wherein a longitudinal length of the contact spring member, with the projecting strip and the recessed strip, is substantially equal to a longitudinal length of the retaining groove.

26. A large current female terminal as claimed in claim 22, wherein the electric contact part is provided at one end of the large current male terminal, the wire crimping part is provided at the other end of the large current male terminal, and the collar is provided between the electric contact part and the wire crimping part.

27. A large current female terminal comprising:

an electric contact part having a hollow cylindrical shape, the electric contact part having an inner diameter to allow a male terminal to be inserted thereinto;

a wire crimping part having a hollow cylindrical shape, the wire crimping part having an inner diameter to allow a wire to be inserted thereinto; and a compressed part formed by compressing a mid-portion of a conductive pipe and by bending the compressed mid-portion;

wherein the electric contact part, the wire crimping part, and the compressed part are integrally formed of the conductive pipe which is continuous around the circumference thereof.

28. A large current female terminal as claimed in claim 27, further comprising:

an engaging groove provided along an inner circumference of the electric contact part; and a contact spring member mounted in the engaging groove.

29. A large current female terminal as claimed in claim 28, wherein the contact spring member has a projecting strip and a recessed strip, the projecting strip resiliently bulging outward from a cylindrical main body of the contact spring member and the recessed strip resiliently bulging inward.

30. A large current female terminal as claimed in claim 29, wherein a longitudinal length of the contact spring member, with the projecting strip and the recessed strip, is substantially equal to a longitudinal length of the engaging groove.

31. A large current female terminal as claimed in claim 27, wherein the electric contact part is provided at one end of the large current female terminal, the wire crimping part is provided at the other end of the large current female terminal.

32. A large current female terminal as claimed in claim 27, wherein the compressed part is bent at substantially right angles.

33. A large current female terminal as claimed in claim 27, the male terminal includes:

an electric contact part having a hollow cylindrical shape, the electric contact having a substantially conical nose;

a wire crimping having a hollow cylindrical shape, the wire crimping part having an inner diameter to allow a wire to be inserted thereinto; and a collar having a diameter larger than at least each of the electric contact part and the wire crimping part, wherein the electric contact part, the wire crimping part, and the collar are integrally formed of a conductive pipe which is continuous around the circumference thereof.

34. A large current female terminal as claimed in claim 33, the male terminal further includes:

a retaining groove provided along an outer circumference of the electric contact part; and a contact spring member mounted in the retaining groove.

35. A large current female terminal as claimed in claim 34, wherein the contact spring member has a projecting strip and a recessed strip, the projecting strip resiliently bulging outward from a cylindrical main body of the contact spring member and the recessed strip resiliently bulging inward.

36. A large current female terminal as claimed in claim 35, wherein a longitudinal length of the contact spring member, with the projecting strip and the recessed strip, is substantially equal to a longitudinal length of the retaining groove.

37. A large current female terminal as claimed in claim 33, wherein the electric contact part is provided at one end of the large current male terminal, the wire crimping part is provided at the other end of the large current male terminal, and the collar is provided between the electric contact part and the wire crimping part.

* * * * *